US008100777B1

(12) United States Patent
Stites et al.

(10) Patent No.: US 8,100,777 B1
(45) Date of Patent: Jan. 24, 2012

(54) CORNER ASSEMBLY FOR USE WITH POOL TABLES

(75) Inventors: Kelye Stites, Colleyville, TX (US); Martin G. Bohn, North Richland Hills, TX (US)

(73) Assignee: Valley-Dynamo, LP, Richland Hills, TX (US)

( * ) Notice: Subject to any disclaimer, the term of this patent is extended or adjusted under 35 U.S.C. 154(b) by 0 days.

(21) Appl. No.: 12/850,100

(22) Filed: Aug. 4, 2010

(51) Int. Cl.
*A63D 15/02* (2006.01)
*A63D 15/06* (2006.01)
*A63D 15/00* (2006.01)

(52) U.S. Cl. ..... 473/28; 473/31

(58) Field of Classification Search ..... 473/28, 473/31, 32
See application file for complete search history.

(56) References Cited

U.S. PATENT DOCUMENTS 244,368 A * 7/1881 Bailey ..... 473/28
265,658 A * 10/1882 Collender ..... 473/28
648,561 A * 5/1900 Haskell ..... 473/28
1,101,847 A * 6/1914 Haase ..... 473/28
1,154,865 A * 9/1915 Jaeger ..... 473/28
3,088,740 A * 5/1963 Erickson ..... 273/126 R
3,138,387 A * 6/1964 Michel et al. ..... 473/159
3,729,192 A * 4/1973 Nielsen ..... 473/30
4,579,342 A * 4/1986 Mortensen ..... 473/3
4,900,021 A * 2/1990 Lalick ..... 473/28
5,451,187 A * 9/1995 Brinkley ..... 473/28
5,833,546 A * 11/1998 Wang ..... 473/3
7,011,585 B1 * 3/2006 Valenzuela ..... 473/31

* cited by examiner

*Primary Examiner* — Mitra Aryanpour
(74) *Attorney, Agent, or Firm* — Husch Blackwell LLP

(57) ABSTRACT

A pool table corner assembly for forming a corner pocket including a pair of adjacent rail members, a corner casting member, and a pocket member. Each rail member includes a supporting flange portion, a recessed portion, and a generally horizontal top surface. The corner casting member includes an overhanging mounting flange for mating with the recessed portion of each rail member thereby allowing the upper surface of the corner casting member to lie flush with the top surface of each rail member, and a recessed portion extending along at least a portion of its inner wall for receiving a lip portion associated with the pocket member, the lip portion having a top surface which lies flush with the upper surface of the corner casting member. In another embodiment, the corner casting member includes at least one spike member for engaging the supporting flange portion of the corresponding rail member.

17 Claims, 6 Drawing Sheets

CORNER ASSEMBLY FOR USE WITH POOL TABLES

BACKGROUND OF INVENTION

The present invention relates to a low profile pool table corner assembly and more particularly, to a flush mounted corner assembly adapted to be secured to the side rails of a pool table.

Pool or pocket billiards is a cue sport game played on a table with six receptacles or pockets positioned and located along the side rails into which pool balls are deposited as the main goal of play. There are many different sizes and styles of pool tables but all include four corner pockets and two side pockets. In this regard, the bed or playing surface of the pool table is provided with a cut-out portion for each of the corner pockets and for the two side pockets. The rails of the pool table are cut to provide gaps adjacent each of the cut-out portions and each rail includes a cushioned portion which provides a consistent bounce to the pool balls as they strike the side rails. A corner assembly is then mounted in the gaps associated with the four corner pockets positioned to receive a pool ball which falls through the cut-out portion and into the pocket.

The prior art corner assembly 100 as best illustrated in FIGS. 1-3 requires a corner casting member 102 which is usually made of a durable metal material and is provided with a pair of mounting flanges 104 and 106 (FIG. 3) which are mounted at the ends of the rail members 108 and 110 as illustrated in FIG. 2. The end wall portions 112 and 114 of the corner casting member 102 are mounted on the support flanges 116 and 118 extending from the bottom portion of the rail members 108 and 110 toward the corner casting member 102. The corner casting member 102 includes two cylindrical projections 120 and 122 (FIG. 3) positioned and located for engagement with the respective apertures 124 and 126 formed in the support flanges 116 and 118 of the rail members 108 and 110. A bolt or other fastening member 128 and 130 is insertably received and tightened from the bottom surface through the respective apertures of the support flanges 116 and 118, and then into the respective apertures 132 and 134 defined in the projections 120 and 122. The prior art corner casting member 102 is mounted to the ends of the rail members 108 and 110 and the pocket member 136 is then attached to the corner casting member 102 so that it is supported in the correct position to receive a pool ball played into the pocket 136 during play.

The top flanges 104 and 106 of the prior art corner casting member 102 extend from and overhand both opposite end wall portions 112 and 114 and extend toward the terminal edge portions 138 and 140 of the rail members 108 and 110. Once the prior art corner casting member 102 is positioned and located for attachment to the adjacent side rail members 108 and 110 as illustrated in FIGS. 1 and 2, the overhanging top flanges 104 and 106 of the casting member 102 overlap and lie on top of the top surface of the rail members 108 and 110 as best illustrated in FIG. 1. The surface at the intersection of the distal ends of the top flanges 104 and 106 and the top surface of the rail members 108 and 110 are not flush, but instead are raised or uneven because the top flanges 104 and 106 sit on top of the top surface of the rail members 108 and 110. The conventional prior art corner casting member 102 thus forms a raised or uneven surface or joint 142 and 144 at their respective joinder intersections as best illustrated in FIG. 1. In addition, when the pocket member 136 is attached to the corner casting member 102, the lip portion 146 likewise rests upon the top surface of the casting member 102 and forms an additional raised or uneven surface along the entire extent of the pocket lip portion 146.

While such prior art corner casting members are suitable for the purposes just described, the raised joints 142 and 144 and the raised pocket lip portion 146 are not ideal for play from the respective corners. In this regard, it is generally recognized that success in pool games or billiards depends upon the player's ability to direct the cue ball to a desired region of the playing surface so as to strike an object ball in a certain manner to direct the object ball to one of the pool pockets. Thus, aligning and aiming of the cue stick with respect to the cue ball is important to achieve the desired movement of the object ball. The raised joints 142 and 144 and the raised lip pocket portion 146 can interfere with and hinder the cue stick alignment process when shooting from the corner of the pool table. More particularly, these raised surfaces cause the cue stick to be positioned and located higher than normal when shooting over the corer casting member 102, and the raised corner joints 142, 144 and 146 can cause damage to the cue stick. In addition, the uneven surfaces of the corner joints likewise cause pool players to make more difficult angle shots, particularly when the cue ball needs to be struck near its lower surface. All of these factors increase the complexity of any shot from the corner of the pool table.

It is therefore desirable to provide a corner casting member which can be mounted flush with the top surface of the rail members. It is desirable to provide a corner casting member which will enable the lip portion of the pocket member to be mounted flush with the top surface of the corner casting member. It is further desirable to provide an improved and secure attachment of the corner casting member to the rail members.

In an effort to overcome the aforementioned shortcomings, the present invention provides a corner casting member which is mounted flush with the top surface of the rail members.

SUMMARY OF INVENTION

The present invention relates to various embodiments of a low profile corner assembly for use with pool tables wherein the corner casting member includes a mounting flange positioned flush with the top surfaces of the adjacent rail members. The present corner assembly also allows the pocket member to be positioned flush with the top surface of the corner casting member. The present invention overcomes many of the shortcomings and limitations of the prior art corner assemblies discussed above and teaches the construction and operation of a corner assembly adaptable for use with a wide variety of different types of pool tables wherein the corner casting member is fitted flush with and between a respective pair of rail members.

In one aspect of the present invention, the present corner assembly includes a corner casting member having two rail engaging sections for securing the corner casting member to specifically formed adjacent rail members. The two rail engaging sections associated with each corner casting member include means for securing the present corner casting member to the adjacent rail members, each rail engaging section having a mounting flange for mating with a corresponding recessed portion formed on the top edge of the adjacent rail member. The mounting flanges extend horizontally and outwardly from the terminal end walls associated with the present corner casting member toward the adjacent rail members and are positioned and located for being received into the corresponding recesses formed and positioned on the top surface of the respective adjacent rail members such that the upper surface of the present corner casting member is positioned flush with the top surface of the adjacent rail members. This smooth and even surface joinder of the present corner casting member and the adjacent rail members improves a player's ability to aim and align the cue stick when shooting near the corner assembly.

The present corner casting member further includes a pair of planar ribs associated respectively with each of two cylindrical projections which are likewise positioned and located for mating with respective apertures formed in the support flanges associated with the adjacent rail members. Each pair of planar ribs extend radially outwardly from each of the cylindrical projections and are positioned and located in substantially perpendicular relationship to each other to provide additional support to the cylindrical projections. In one aspect of the present invention, a protrusion or spike member extends vertically downward from the center of the top edge portion of each rib for mating with and engaging the top surface of the support flanges associated with the adjacent rail members. The corner casting member is further secured in place with the adjacent rail members when the protrusions or spike members engage the corresponding support flanges, thereby providing additional rigidity to the overall corner assembly and further facilitating attachment of the corer casting member to the adjacent rail members.

The present corner casting member likewise includes a recessed portion for receiving the lip portion of the pocket member for allowing the pocket member to be mounted flush with the top surface of the corner casting member.

These and other objects and advantages of the present invention will become more apparent to those skilled in the art after considering the following detailed specification taken in conjunction with the accompanying drawings.

BRIEF DESCRIPTION OF DRAWINGS

For a better understanding of the present invention, reference may be made to the accompanying drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein. Like numbers utilized throughout the various Figures designate like or similar parts or structure.

DETAILED DESCRIPTION

The present invention is generally embodied in a pool table and pertains to an improved low profile corner assembly which may be adapted for use with a wide variety of different types of pool tables. A conventional pool table is comprised of a plurality of adjacent rail members which fit together to form a rectangular frame adapted to be positioned on a supporting table structure. The pool table generally includes a bed or playing surface formed of slate or any other appropriate playing surface material which is supported on the table-like structure and typically is covered with an appropriate fabric or cloth material suitable for play. The rail members are mounted either to the playing surface or on a support frame for the playing surface with the free ends thereof forming a gap for receiving either the corner pocket assembly or the side pocket assembly. The corner assemblies constructed in accordance with the teachings of the present invention are fitted between each pair of adjacent rail members in a manner described in detail below. The present corner assemblies are provided at the four corners of the pool table.

Figure 4:
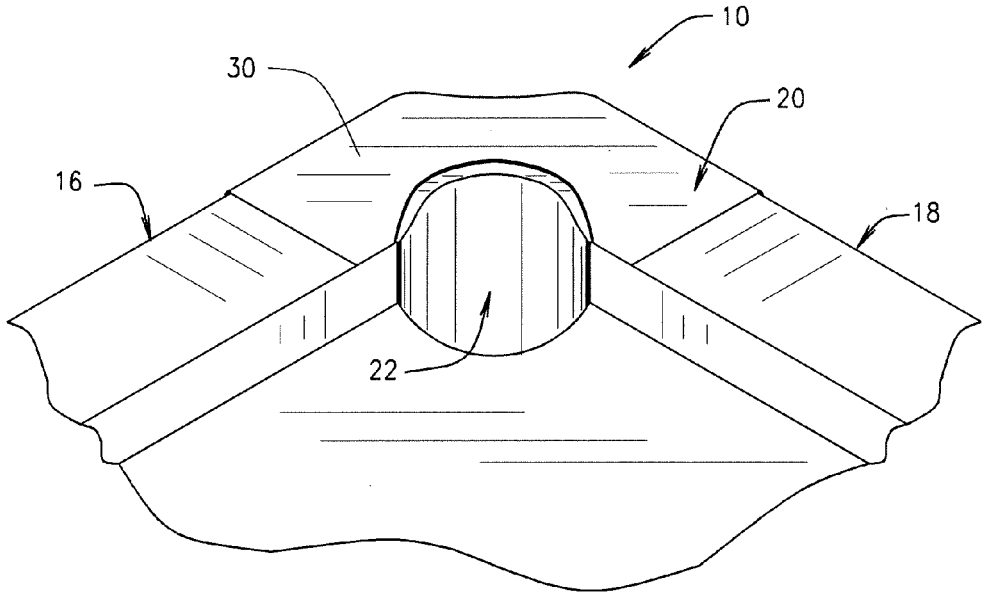
FIG. 4 is a partial perspective cut-away view of a corner casting member attached to the adjacent side rail members of a conventional pool table constructed in accordance with the teachings of the present invention.
Figure 5:
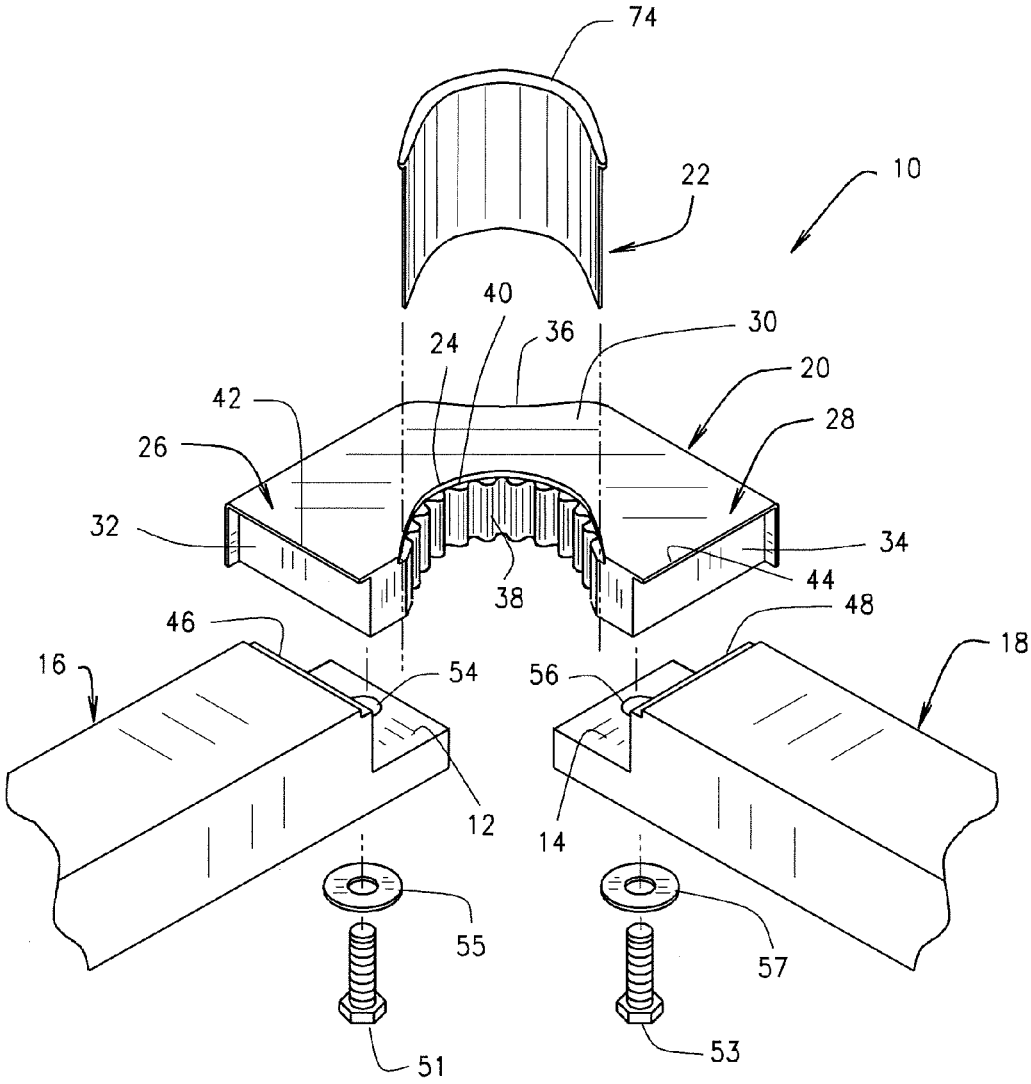
FIG. 5 is an exploded perspective view of FIG. 4.
Figure 7:
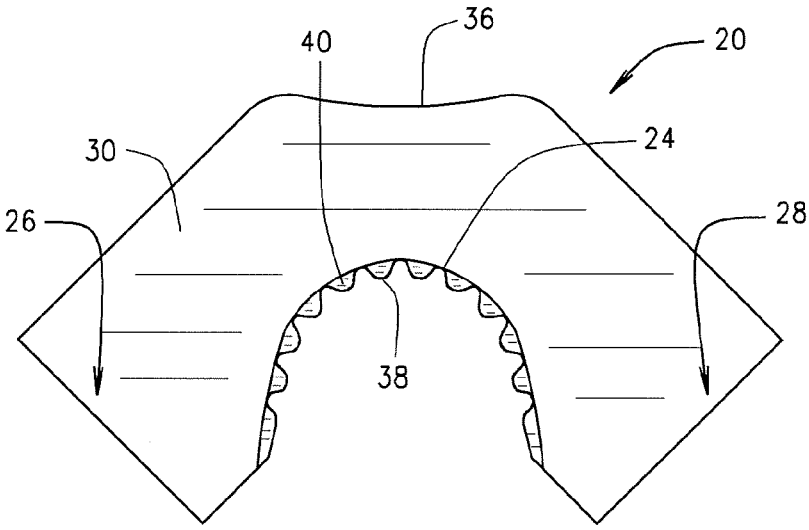
FIG. 7 is a top plan view of the present corner casting member of FIGS. 4-6.

Referring to the drawings, FIGS. 4-8 illustrate various views of one embodiment of a corner assembly constructed in accordance with the teachings of the present invention. FIG. 5 illustrates an exploded view of the present corner assembly 10 shown mounted on the supporting flanges 12 and 14 which extend respectively from and are associated with the adjacent rail members 16 and 18. The corner assembly 10 generally includes a corner casting member 20, a pocket member 22 mounted on the inner semi-circular edge portion 24 of the casting member 20, and two rail engaging sections 26 and 28 for securing the corner casting member 20 to the rail members 16 and 18. As used herein, front, back, upper, lower and other position terms are used to describe the invention as oriented in FIG. 5.

Figure 6:
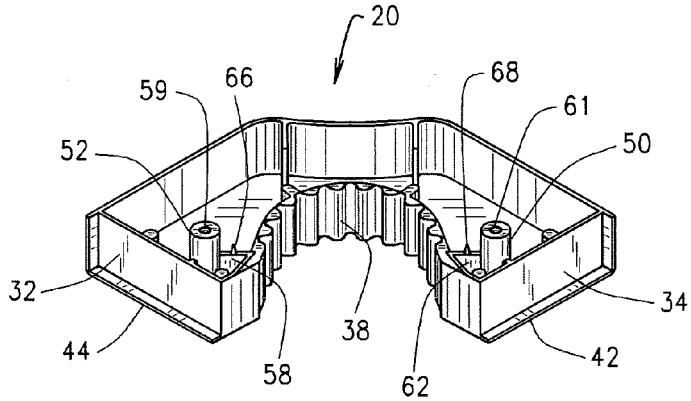
FIG. 6 is a bottom perspective view of the present corner casting member of FIG. 4.

As best illustrated in FIGS. 5 and 6, the corner casting member 20 is generally of a unitary, arcuate, rigid structure and includes an upper surface 30 of the desired shape, preferably a somewhat semi-circular or arcuate shape as illustrated, two terminal end walls 32 and 34 facing the adjacent rail members 16 and 18, an outer wall 36, and an inner semi-circular or arcuate wall 38 for engagement with a pocket member 22. The upper surface 30 extends transversely outward and overhangs the terminal end walls 32 and 34 as best illustrated in FIGS. 5 and 6, the overhanging upper surfaces 30 forming the mounting flanges 42 and 44. The top surface of the mounting flanges 42 and 44 is contiguous with the upper surface 30 of the corner casting member 20. The upper surface 30 likewise includes a recessed portion 40 adjacent the inner semi-circular edge portion 24 for receiving the lip portion 74 of the pocket member 22 as will be hereinafter further explained. The end walls 32 and 34, inner wall 38 and outer wall 36 form the outer peripheral circumference of the corner casting member 20. As illustrated, the outer curved wall 36 of the corner casting member 20 extends through a 90° arc so that the terminal end walls 32 and 34 lie in substantially perpendicular planes.

The two opposite rail engaging sections 26 and 28 are provided to secure the corner casting member 20 to the rail members 16 and 18, each rail engaging section having a corresponding mounting flange 42 and 44 for mating with the corresponding elongated recessed portions 46 and 48 formed on the top edge portion of the rail members 16 and 18 as best illustrated in FIG. 5. The underside portion of the rail engaging sections 28 and 28 likewise each include a corresponding cylindrical projection 50 and 52 for mating with the corresponding apertures 54 and 56 formed on the supporting flanges 12 and 14 associated with the rail members 16 and 18 as best shown in FIG. 6. In this regard, the rail members 16 and 18 are formed to include the notched supporting flanges 12 and 14, the recessed portions 46 and 48, and the apertures 54 and 56. Each of the cylindrical projections 50 and 52 likewise includes an internal threaded bore 59 and 61 to receive and engage a threaded bolt or other threaded fastener such as the threaded members 51 and 53 (FIG. 5) for attaching the corner casting member 20 to the rail members 16 and 18. The cylindrical projections 50 and 52 each include an external smooth surface to be inserted into the corresponding apertures 54 and 56 on the supporting rail flanges 12 and 14. When the rail engaging sections 26 and 28 of the corner casting member 20 are positioned and located on the supporting rail flanges 12 and 14 for attachment thereto, the cylindrical projections 50 and 52 are received into the apertures 54 and 56 and the overhanging mounting flanges 42 and 44 are received into the recessed portions 46 and 48 such that the upper surface 30 of the present corner casting member which includes the upper surface of the mounting flanges 42 and 44 mates flush with the top surface of the rail members 16 and 18 as best illustrated in FIG. 4.

The inner curved wall 38 of the corner casting member 20 extends vertically downward from the upper surface 30 and forms a serpentine or wavy surface for mating with the pocket member 22. Each of the adjacent rail members 16 and 18 is formed with a supporting flange 12 and 14 extending from the bottom portion of the rail member toward the corner casting member 20 as previously explained. The apertures 54 and 56 associated with the supporting flanges 12 and 14 are slightly larger than the cylindrical projections 50 and 52 so as to receive the same but the dimensions are such as to provide a snug fit. A threaded bolt or other threaded fastening member 51 and 53 is inserted through an optional washer member 55 and 57, through the apertures 54 and 56 of the supporting rail flanges 12 and 14, and then into the respective bores 59 and 61 formed in the center of the cylindrical projections 50 and 52. Obviously, the corner casting member 20 can be shaped and dimensioned as necessary for engagement with various types of pool tables.

As best shown in FIGS. 4-6, each of the mounting flanges 42 and 44, which are extensions of the upper surface 30, extend horizontally toward the adjacent rail member 16 and 18 and overhang the terminal end walls 32 and 34 as previously explained. The mounting flanges 42 and 44 are fitted into the corresponding elongated recesses 46 and 48 of the rail members 16 and 18 such that the upper surface 30 of the corner casting member 20 is positioned flush with the top surface of the rail member 16 and 18. The corner casting member 20 is then secured in place with the adjacent rail members 16 and 18 through the use of the threaded fastening members 51 and 53 as previously explained.

Figure 8:
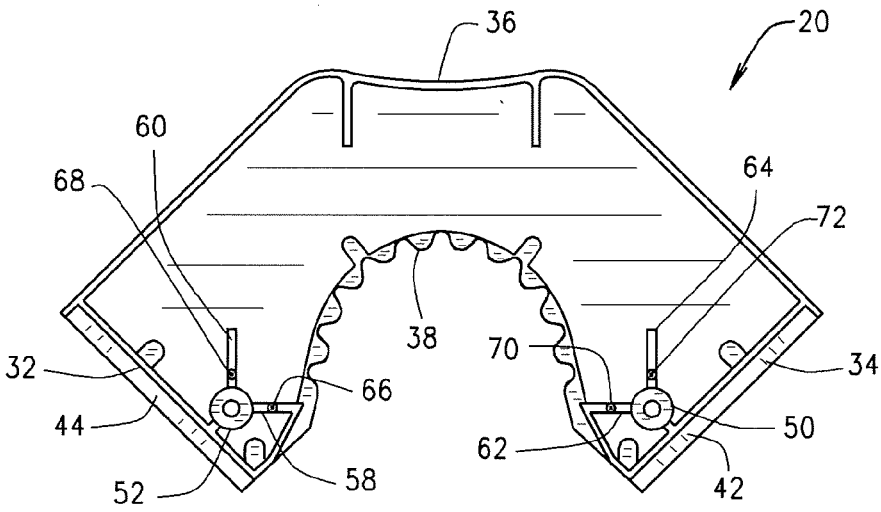
FIG. 8 is a bottom plan view of the present corner casting member of FIGS. 4-6.
Figure 9:
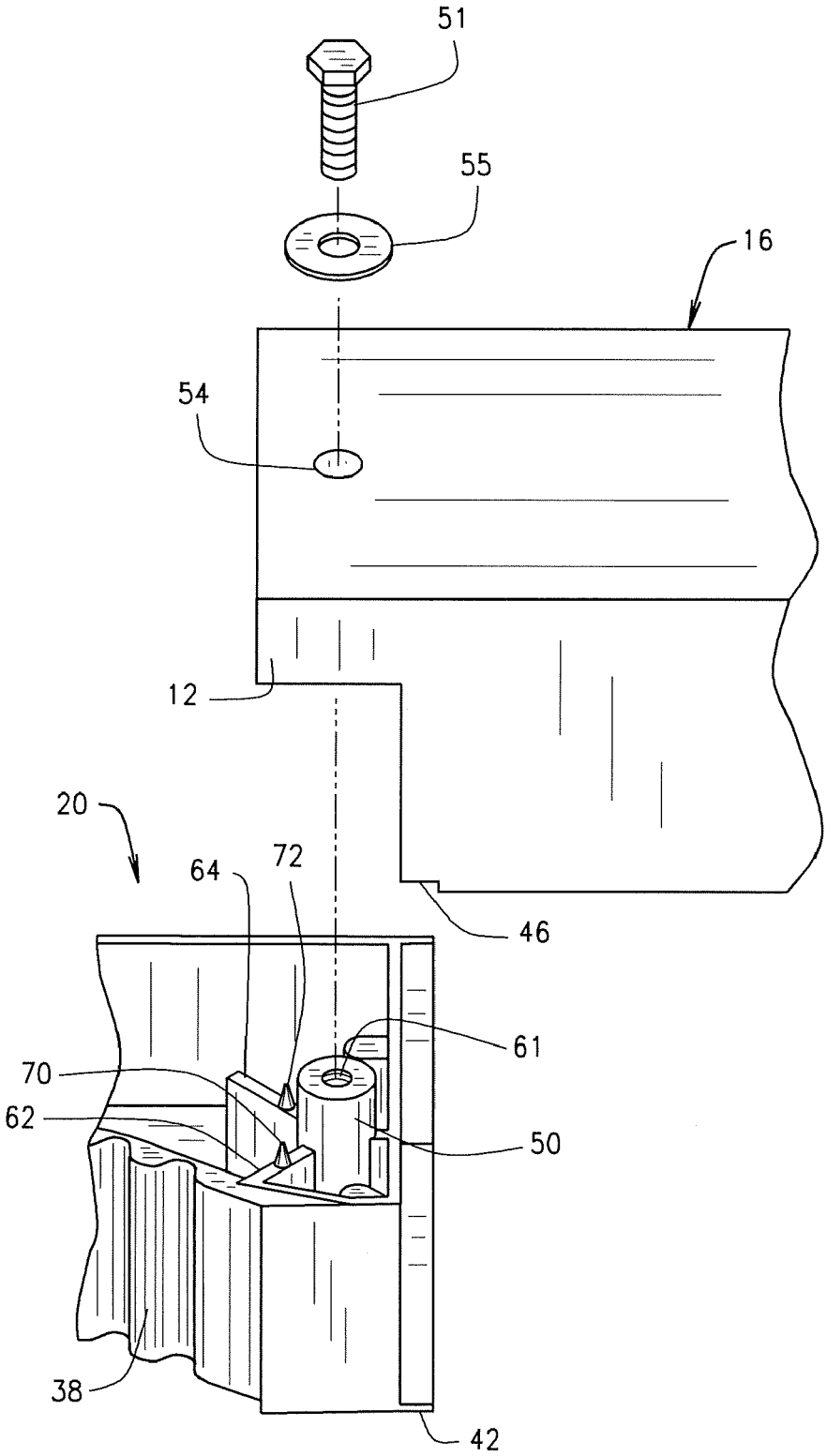
FIG. 9 is an exploded partial perspective view of a portion of the present corner casting member prior to attachment to one of the side rail members showing the present protrusions or spike members constructed in accordance with the teachings of the present invention.

In a preferred embodiment, each of the cylindrical projections 50 and 52 include a pair of planar ribs 58 and 60, and 62 and 64, as best illustrated in FIG. 8, each pair of ribs extending radially outwardly from the corresponding projection in substantially perpendicular relationship to each other. One rib of each pair of planar ribs such as the ribs 58 and 62 extends from the cylindrical projections 50 and 52 to the inner surface of the curved inner wall 38 adjacent the terminal end portion of the arcuate inner wall 38. An elongated protrusion or a spike member 66, 68, 70 and 72 extends from the center of the top edge portion of each rib 58, 60, 62 and 64 for mating with and engaging the top surface of the supporting rail flanges 12 and 14. Since the rail members 16 and 18 are typically made of wood, the protrusions or spike members 66, 68, 70 and 72 are typically driven into the wooden top surface of the supporting rail flanges 12 and 14 as the corner casting member 20 is fastened and tightened into joinder with the rail members 16 and 18 through the use of the threaded fastening members 51 and 53. Engagement of the spike members 66, 68, 70 and 72 with the supporting rail flanges 12 and 14 further rigidifies and secures the attachment of the corner casting member 20 to the rail members 16 and 18. As a result, in this particular embodiment, both the fastening members 51 and 53, and the spike members 66, 68, 70 and 72 provide attachment means for securing and maintaining the corner casting member 20 in the desired position when attached to the adjacent rail members.

Figure 1:
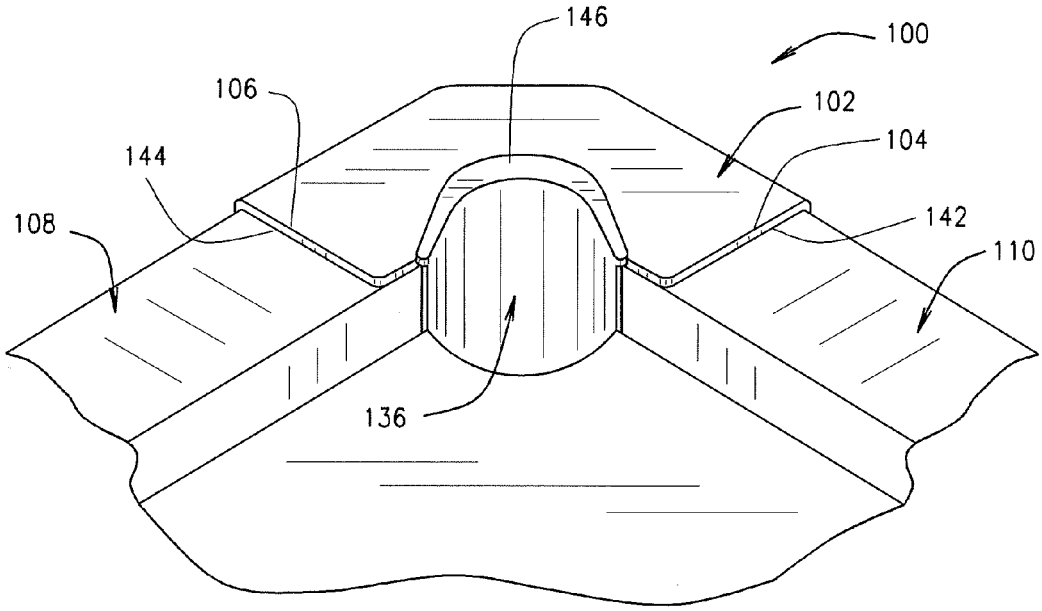
FIG. 1 PRIOR ART
FIG. 1 is a partial perspective cut-away view of a conventional prior art corner casting member attached to the adjacent side rail members of a conventional pool table.
Figure 3:
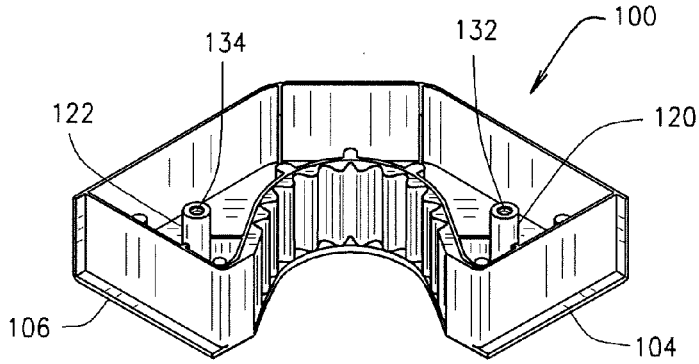
FIG. 3 PRIOR ART
FIG. 3 is a bottom perspective view of the conventional prior art corner casting member of FIG. 1.
Figure 2:
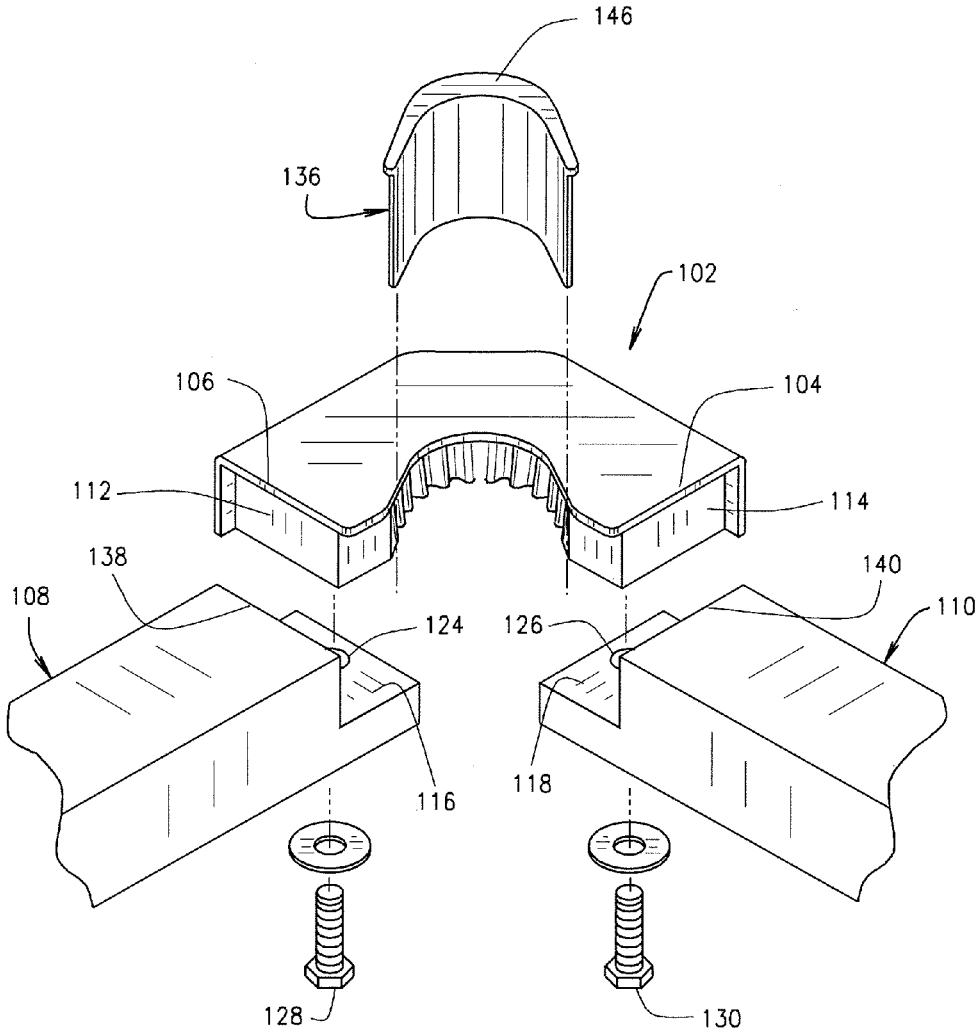
FIG. 2 PRIOR ART
FIG. 2 is an exploded perspective view of FIG. 1.

While the pocket member 22 may be of any construction such as a sewn leather pocket having at least a lip portion for engaging the corner casting member 20, the pocket member 22 illustrated in FIGS. 4 and 5 represents a typical prior art pocket member which is of a one-piece molded synthetic construction. The pocket member 22 includes an outwardly extending lip portion 74 which, in the prior art corner casting arrangement illustrated in FIGS. 1-3, rested on top of the upper surface of the corner casting member. To alleviate this additional raised surface, the present corner casting member 20 includes a recessed area or portion 40 located adjacent the inner semi-circular or arcuate edge portion 24 for cooperatively receiving the lip pocket portion 74 when the pocket member 22 is placed in operative position within the casting member 20. The curved inner wall 38 is shaped to conform to the conventional pocket member 22 and the recessed area 40 is shaped and dimensioned to receive the lip portion 74 such that the top surface of the lip pocket portion 74 lies flush with the upper surface 30 of the corner casting member 20 adjacent the edge portion 24 as illustrated in FIG. 4. This arrangement and construction eliminates the raised intersections 142, 144 and 146 illustrated in FIG. 1 in association with the use of a prior art corner casting member such as the prior art casting member 102. The present corner casting member 20 therefore provides a smooth, flush mating surface with both the adjacent rail members 16 and 18 and the pocket member 22 when the present corner casting member 20 is attached to the side rail members 16 and 18 and the pocket member 22 is attached in a conventional manner to the casting member 20.

Due to the smooth and even surface fit of the present low profile corner assembly 10, the present corner assembly 10 as illustrated in FIG. 4 not only provides a highly pleasing aesthetic appearance to the pool table, the flush mounted corner assembly 10 also improves a player's ability to aim and align the cue stick near the corner assembly.

It is also recognized and anticipated that the overall dimensions of the present corner assembly as well as the specific shape and configuration of the present corner casting member 20 and the rail engaging sections 26 and 28 associated therewith are also subject to wide variations and may be sized and shaped into a wide variety of different sizes and configurations so as to be compatible with the size and shape of the particular pool table onto which the present structures may be mounted, or to conform with any space limitations associated therewith out impairing the teachings and practice of the present invention.

It is also understood that various modifications may be made to all of the various components comprising the present corner assembly 10 as well as the various embodiments described herein without departing from the spirit and scope of the present invention.

Thus, there has been shown and described several embodiments of a novel flush mounted low profile pool table corner assembly. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention and the scope of the present disclosure is not intended to be limited solely to the embodiments shown herein. All structural and functional equivalents to the elements of the various embodiments described throughout this disclosure that are known or later come to be known to those of ordinary skill in the art are expressly incorporated herein by reference and are intended to be encompassed by this disclosure.

The invention claimed is:

1. A corner assembly for forming a corner pocket in a pool table, said corner assembly comprising:

a pair of adjacent side rail members, a corner casting member, and a pocket member;

each of said side rail members including a supporting flange portion, a recessed portion, and a generally horizontal top surface;

said corner casting member being positioned and located between said adjacent pair of side rail members and including inner and outer wall portions, terminal end wall portions, a generally horizontal upper surface extending between said inner, outer and end wall portions, said upper surface overhanging each of said terminal end wall portions so as to form a mounting flange for mating with the recessed portion associated with each of said side rail members;

at least a portion of said corner casting member mating with the support flange portion of each of said side rail members for attachment thereto and said mounting flanges mating with the recessed portion of each of said side rail members, and the generally horizontal upper surface of said corner casting member lying flush with the top surface of each of said side rail members when said corner casting member is positioned and located therebetween;

said pocket member being engageable with said corner casting member and mating with at least a portion of the inner wall portion thereof.

2. The corner assembly defined in claim 1 wherein each of the supporting flange portions associated with the adjacent side rail members includes an aperture extending therethrough, and wherein said corner casting member includes a pair of projections positioned and located for each respectively engaging one of said apertures, each of said projections having an internal threaded portion for receiving a threaded fastener member, a threaded fastener member extending through each of said apertures and into the internal threaded portion of each of said projections for attaching the corner casting member to said adjacent side rail members.

3. The corner assembly defined in claim 2 including at least one spike member positioned adjacent at least one of said projections, the at least one spike member extending in a direction parallel to said at least one projection for engagement with the supporting flange portion associated with the corresponding side rail member.

4. The corner assembly defined in claim 2 including at least one planar rib extending outwardly from one of said projections, and at least one spike member extending vertically from a top edge of said planar rib, said at least one spike member being positioned for engagement with the supporting flange portion associated with the corresponding side rail member.

5. The corner assembly defined in claim 1 wherein at least a portion of the inner wall portion of said corner casting member includes a wavy surface.

6. The corner assembly defined in claim 1 wherein the upper surface of said corner casting member further includes a recessed portion extending along at least a portion of said inner wall portion adjacent the top edge portion thereof for receiving a lip portion associated with said pocket member, said lip portion having a top surface which lies flush with the upper surface of said corner casting member when the pocket member is engaged with said corner casting member.

7. A corner assembly for forming a corner pocket in a pool table, said corner assembly comprising:

a pair of adjacent spaced apart rail members, a corner casting member, and a pocket member;

each of said rail members including a supporting flange portion, a recessed portion, and a generally horizontal top surface;

said corner casting member being positionable between said pair of adjacent spaced apart rail members and including a pair of rail engaging sections for securing the corner casting member to said pair of adjacent rail members;

each of said pair of rail engaging sections having a terminal end wall and a mounting flange extending outwardly therefrom, each of said mounting flanges being engageable with the recessed portion associated with one of said pair of rail members such that the top surface of said mounting flanges lie flush with the top surface of each of said pair of rail members when said corner casting member is positioned between said pair of adjacent rail members;

at least a portion of each of said rail engaging sections mating with the supporting flange portion of each of said rail members for attachment thereto, each of said rail engaging sections including a projection positioned and located for engaging an aperture extending through the corresponding supporting flange portion associated with said adjacent rail members when said corner casting member is positioned between said pair of adjacent rail members;

said pocket member being engageable with said corner casting member.

8. The corner assembly defined in claim 7 wherein the projection associated with each of said rail engaging sections includes an internal threaded portion for receiving a threaded fastener member, a fastener member extending through each of said apertures and into the internal threaded portion of the projection associated with each of said rail engaging sections for attaching the corner casting member to said adjacent rail members.

9. The corner assembly defined in claim 7 wherein said pair of rail engaging sections are unitary with said corner casting member.

10. The corner assembly defined in claim 7 including at least one protrusion positioned adjacent each of said projections associated with said pair of rail engaging sections, the at least one protrusion extending in a direction parallel to said corresponding projection for engagement with the supporting flange portion associated with the corresponding rail member.

11. The corner assembly defined in claim 7 including at least one planar rib extending outwardly from each of said projections and at least one protrusion extending vertically from a top edge of said planar rib, said at least one protrusion being positioned for engagement with the supporting flange portion associated with the corresponding rail member.

12. The corner assembly defined in claim 7 wherein said corner casting member includes an inner wall portion, said pocket member mating with at least a portion of said inner wall portion, said corner casting member including a recessed portion extending along at least a portion of said inner wall portion adjacent the top edge thereof for receiving a lip portion associated with said pocket member, said lip portion having a top surface which lies flush with a top surface of said corner casting member when said pocket member is engaged with the corner casting member.

13. A corner assembly for forming a corner pocket in a pool table, said corner assembly comprising:

a pair of adjacent rail members, a corner casting member, and a pocket member;

each of said rail members including a supporting flange portion, a recessed portion, and a generally horizontal top surface;

said corner casting member being positioned and located between said adjacent pair of rail members and including inner and outer wall portions, terminal end wall portions, a generally horizontal upper surface extending between said inner, outer and end wall portions, said upper surface overhanging and extending beyond each of said terminal end wall portions so as to form a mounting flange for mating with the recessed portion associated with each of said rail members;

at least a portion of said corner casting member mating with the support flange portion of each of said rail members for attaching said corner casting member to said pair of rail members, the generally horizontal upper surface of said corner casting member lying flush with the top surface of each of said rail members when said corner casting member is positioned and located therebetween;

said pocket member being engageable with said corner casting member and mating with at least a portion of the inner wall portion thereof; and the upper surface of said corner casting member further including a recessed portion extending along at least a portion of said inner wall portion adjacent the top edge thereof for receiving a lip portion associated with said pocket member, said lip portion having a top surface which lies flush with the upper surface of said corner casting member when the said pocket member is engaged with said corner casting member.

14. The corner assembly defined in claim 13 wherein each of the supporting flange portions associated with the adjacent rail members includes an aperture extending therethrough and wherein said corner casting member includes a pair of projections, each of said projections being positioned and located for engaging a respective one of said apertures, each of said projections being configured to provide secure attachment of the corner casting member to said pair of rail members.

15. The corner assembly defined in claim 14 wherein each of said projections includes an internal threaded portion for receiving a threaded fastener member.

16. The corner assembly defined in claim 14 including at least one spike member positioned adjacent each of said projections, the at least one spike member extending in a direction parallel to said projections for engagement with the supporting flange portion associated with the corresponding rail member.

17. A corner assembly for forming a corner pocket in a pool table, said corner assembly comprising:

a pair of adjacent spaced apart side rail members, a corner casting member, and a pocket member;

each of said side rail members including a supporting flange portion, a recessed portion, and a generally horizontal top surface;

said corner casting member being positioned and located between said adjacent pair of spaced apart side rail members and including inner and outer wall portions, terminal end wall portions, a generally horizontal upper surface extending between said inner, outer and end wall portions, said upper surface overhanging each of said terminal end wall portions so as to form a mounting flange for mating with the recessed portion associated with each of said side rail members;

at least a portion of said corner casting member mating with the supporting flange portion of each of said side rail members for attachment thereto, each of said supporting flange portions including an aperture extending therethrough;

said corner casting member including a pair of cylindrical projections positioned and located for respectively engaging one of said apertures associated with said supporting flange portions, said cylindrical projections being receivable within said apertures and including an internal threaded portion for receiving a threaded fastener member therewithin for attaching said corner casting member to said adjacent side rail members;

at least one spike member positioned adjacent each of said cylindrical projections, said at least one spike member extending in a direction parallel to said cylindrical projections for engagement with the supporting flange portion associated with the corresponding side rail member when said corner casting member is attached to said side rail members;

said mounting flanges mating with the recessed portion of each of said side rail members and the generally horizontal upper surface of said corner casting member lying flush with the top surface of each of said side rail members when said corner casting member is positioned and located therebetween;

said pocket member being engageable with said corner casting member and mating with at least a portion of the inner wall portion thereof, the upper surface of said corner casting member including a recessed portion extending along at least a portion of said inner wall portion for receiving a lip portion associated with said pocket member, said lip portion having a top surface which lies flush with the upper surface of said corner casting member when said pocket member is engaged with said corner casting member.

* * * * *